United States Patent [19]

More et al.

[11] Patent Number: 5,008,664

[45] Date of Patent: Apr. 16, 1991

[54] APPARATUS FOR INDUCTIVELY COUPLING SIGNALS BETWEEN A DOWNHOLE SENSOR AND THE SURFACE

[75] Inventors: Henry S. More, Los Altos; Edward C. Fraser, Cupertino; Lawrence R. Bulduc, Cottonwood, all of Calif.

[73] Assignee: Quantum Solutions, Inc., Santa Clara, Calif.

[21] Appl. No.: 468,591

[22] Filed: Jan. 23, 1990

[51] Int. Cl.[5] ..... G01V 1/00

[52] U.S. Cl. ..... 340/854; 340/855; 175/40; 166/250; 166/66

[58] Field of Search ..... 340/854, 855; 175/40, 175/50; 166/250, 66, 66.5

[56] References Cited

U.S. PATENT DOCUMENTS

| | | | |
|---|---|---|---|
| Re. 30,110 | 10/1979 | Huebsch et al. | 166/332 |
| 3,550,682 | 12/1970 | Fowler | 336/107 |
| 3,731,742 | 5/1973 | Sizer et al. | 166/315 |
| 4,002,202 | 1/1977 | Huebsch et al. | 166/332 |
| 4,073,341 | 2/1978 | Parker | 166/65 R |
| 4,129,184 | 12/1978 | Parker | 166/332 |
| 4,161,215 | 7/1979 | Bourne, Jr. et al. | 166/332 |
| 4,191,248 | 3/1980 | Huebsch et al. | 166/323 |
| 4,375,239 | 3/1983 | Barrington et al. | 166/336 |
| 4,407,329 | 10/1983 | Huebsch et al. | 166/332 |
| 4,579,177 | 4/1986 | Going, III | 166/332 |
| 4,736,204 | 4/1988 | Davison | 340/856 |
| 4,806,928 | 2/1989 | Veneruso | 340/856 |
| 4,852,648 | 8/1989 | Akkerman et al. | 166/66.4 |

FOREIGN PATENT DOCUMENTS 2058474A 4/1981 United Kingdom .

OTHER PUBLICATIONS

Steen, L. Van Den, "Inductive Couplers in Underwater Power Distribution Networks Improving their Applicability", Underwater Technology, vol. 12. No. 3, pp. 3–10.

Panex Corporation Brochure *Permant Installation Pressure/Temperature Probe*, Model 1250.

Flopetrol Johnston/Schlumberger Brochure, FJ-725 (6/85).

Paroscientific, Inc. and Series 4000 Digiquartz High Pressure Transducer.

Well Test Instruments, Inc. Brochure, and High Pressure Quartz Crystal Transducer.

*Primary Examiner*—Charles T. Jordan

*Assistant Examiner*—J. Woodrow Eldred

*Attorney, Agent, or Firm*—Limbach, Limbach & Sutton

[57] ABSTRACT

An apparatus employing a set of inductive coils to transmit AC data and power signals between a downhole apparatus (which may include a sensor and a safety valve) and apparatus at the surface of the earth. In a preferred embodiment, the invention inductively couples a low frequency (less than 3 KHz) AC power signal from an outer wellhead coupler coil to an inner wellhead coupler coil wound around a tubing string. The AC signal propagates down a wireline conductor along the tubing string to a first downhole coupler coil (also wound around the tubing string) and is inductively coupled from the first downhole coupler coil to a second downhole coupler coil within the tubing. The power signal is preferably rectified, and then employed to power various items of downhole equipment. Data from a downhole sensor (whose frequency is preferably in the range from about 1.0 KHz to about 1.5 KHz) is impressed on the second downhole coil to modulate the AC power signal. The modulated AC signal is inductively coupled from the second downhole coil to the first downhole coil, and from the inner wellhead coil to the outer wellhead coil, and is demodulated by phase locked loop circuitry at the wellhead to extract the sensor data.

33 Claims, 6 Drawing Sheets

APPARATUS FOR INDUCTIVELY COUPLING SIGNALS BETWEEN A DOWNHOLE SENSOR AND THE SURFACE

FIELD OF THE INVENTION

The invention is an apparatus for transmitting AC data and power signals between a sensor disposed in a well, and apparatus at the surface of the earth above the well. More particularly, the invention is an apparatus employing inductive coils to transmit AC data and power signals between a downhole sensor and apparatus at the surface of the earth.

BACKGROUND OF THE INVENTION

Various systems have been proposed which employ inductive coupling to transmit electromagnetic power, data, and/or control signals between downhole equipment (such as pressure and temperature sensors, perforating guns, and valves) and surface equipment. In such systems, electric signals are induced in a first downhole coil from a second downhole coil adjacent to the first coil. Such inductive coupling desirably eliminates the need to mechanically connect the elements on which the coils are mounted, and thus greatly simplifies the handling of downhole equipment in preparation for (and during) drilling, logging, and producing operations.

It would be desirable to design such inductive coupling transmission systems to have a minimum number of downhole components, to have a high degree of reliability when installed in a well, and to be able to communicate power and data signals across mechanical pressure boundaries, with pressure differentials of up to many thousands of pounds per square inch, without the need for mechanical penetration. It would also be desirable to design such inductive coupling transmission systems so that the passive components (cable, coil windings, etc.) may be permanently installed in a well, while the active components (downhole sensor, transmitter, etc.) which more frequently fail may be installed and retrieved by standard wireline techniques. It would also be desirable to design such inductive coupling transmission systems so that a downhole measuring system may be added to an existing downhole safety valve installation (such as that described in U. S. Pat. No. 4,852,648, issued Aug. 1, 1989, to Akkerman, et al.) with a minimum of added downhole components, and without the need for a tubing run. Furthermore, it would be desirable to design a downhole measuring system that consumes a minimum of power and is compatible with inherently inefficient inductive coupling transmission systems for powering a safety valve.

However, until the present invention, it had not been known how to design inductive coupling transmission systems to have downhole measuring capability, and to embody the above-mentioned desirable features.

SUMMARY OF THE INVENTION

The invention is an apparatus employing a set of inductive coils to transmit AC data and power signals between a downhole apparatus (which may include a sensor and a safety valve) and apparatus at the surface of the earth.

In a preferred embodiment, the invention inductively couples a low frequency (less than 3 KHz, and preferably about 80 Hz) AC power signal from an outer wellhead coupler coil to an inner wellhead coupler coil wound around a tubing string. The AC signal propagates down a wireline conductor along the tubing string to a first downhole coupler coil (also wound around the tubing string) and is inductively coupled from the first downhole coupler coil to a second downhole coupler coil within the tubing. The power signal is employed (preferably after being rectified) to power various items of downhole equipment.

Data from a downhole sensor (whose frequency is preferably in the range from about 1.0 KHz to about 1.5 KHz) is impressed on the second downhole coil to modulate the AC power signal by adding a signal frequency component to the AC power signal. The modulated AC signal is inductively coupled from the second downhole coil to the first downhole coil, and from the inner wellhead coil to the outer wellhead coil, and is demodulated by phase locked loop circuitry at or near the wellhead, to extract the sensor data.

DETAILED DESCRIPTION OF THE PREFERRED EMBODIMENT

Figure 1:
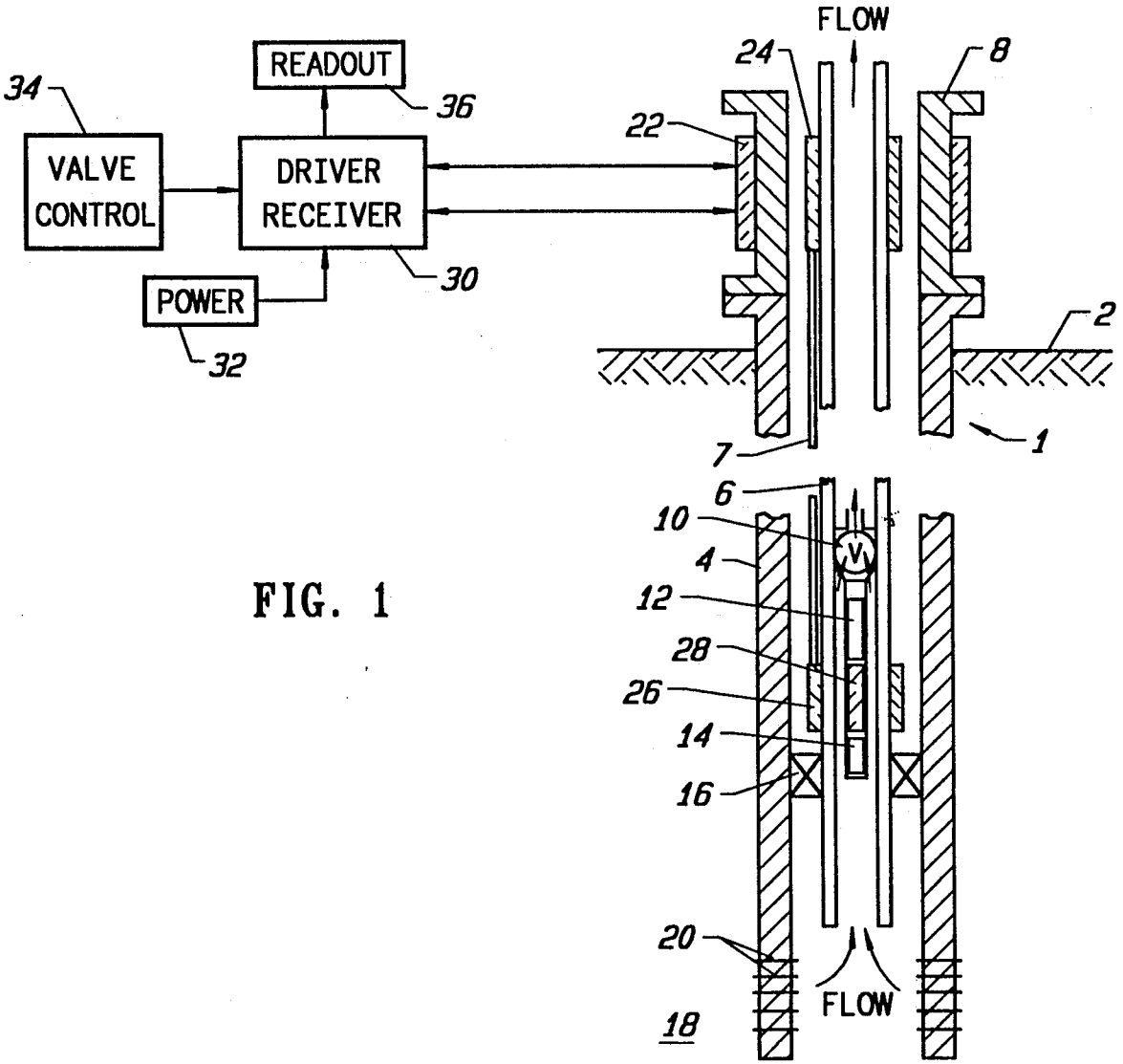
FIG. 1 is a schematic diagram of a preferred embodiment of the invention.

The overall arrangement of the inventive system is shown in FIG. 1. In FIG. 1, driver/receiver circuit 30 is disposed at the earth surface 2 near wellhead casing spool 8 at the wellhead of well 1. Well 1 is cased (by casing 4). Produced fluid flows into the well from subterranean producing region 18 through perforations 20 in casing 4. Packer 16 prevents the produced fluid from flowing up the well outside tubing 8, so that the produced fluid flows upward through the interior of tubing string 8. Sensor 14 measures the pressure and temperature of the produced fluid within tubing string 8 (adjacent sense tube 44) when powered by remotely generated power signals received at coil 28. Safety valve 10 is actuatable in response to solenoid latch mechanism 12 to block fluid flow within the tubing, such as may be desirable in an emergency to contain the well and prevent an uncontrolled release of well fluids. Latch mechanism 12 includes a solenoid which responds to remotely generated power signals received at coil 28.

Circuit 30 receives power from power supply 32 and valve control signals from valve control unit 34, and supplies an AC power and valve control signal to outer wellhead coupler coil 22, which is wound around spool 8. The AC signal should have a primary frequency less than 5 KHz, preferably within the range from 30 Hz to 500 Hz. Optimally, the primary frequencies of 50 Hz and 60 Hz are avoided, since such signals may be subject to interference from other system components, and the primary frequency is within the range from 70 Hz to 100 Hz. Circuit 30 also receives and demodulates data signals impressed on coil 22 by the downhole equipment and preferably has a high source impedance at the frequencies of the data signals to facilitate detection of these signals. Circuit 30 also displays the demodulated data on readout unit 36.

The AC power signal from circuit 30 is inductively coupled from coil 22 to inner wellhead coupler coil 24, which is wound around tubing string 6 with its terminations connected to wireline conductor 7. The AC signal propagates down wireline conductor 7 along tubing string 8 to first downhole coupler coil 26, which is also wound around tubing string 8 and connected to conductor 7. The AC signal is inductively coupled from first downhole coil 26 to second downhole coupler coil 28 within tubing 8.

Electronic circuitry within coil 28 (to be described with reference to FIG. 2, but not shown in FIG. 1) processes the AC power signal received at coil 28.

It will be appreciated that additional pairs of downhole coupler coils may be connected along wireline 7. For example, a third downhole coil may be wound around tubing 8 and connected to wireline 7 at a position between coil 28 and earth surface 2. A fourth couple coil, disposed within tubing 8 opposite such third coil, may be connected to additional downhole equipment (such as a perforating gun, or another pressure/-temperature sensor).

Figure 2:
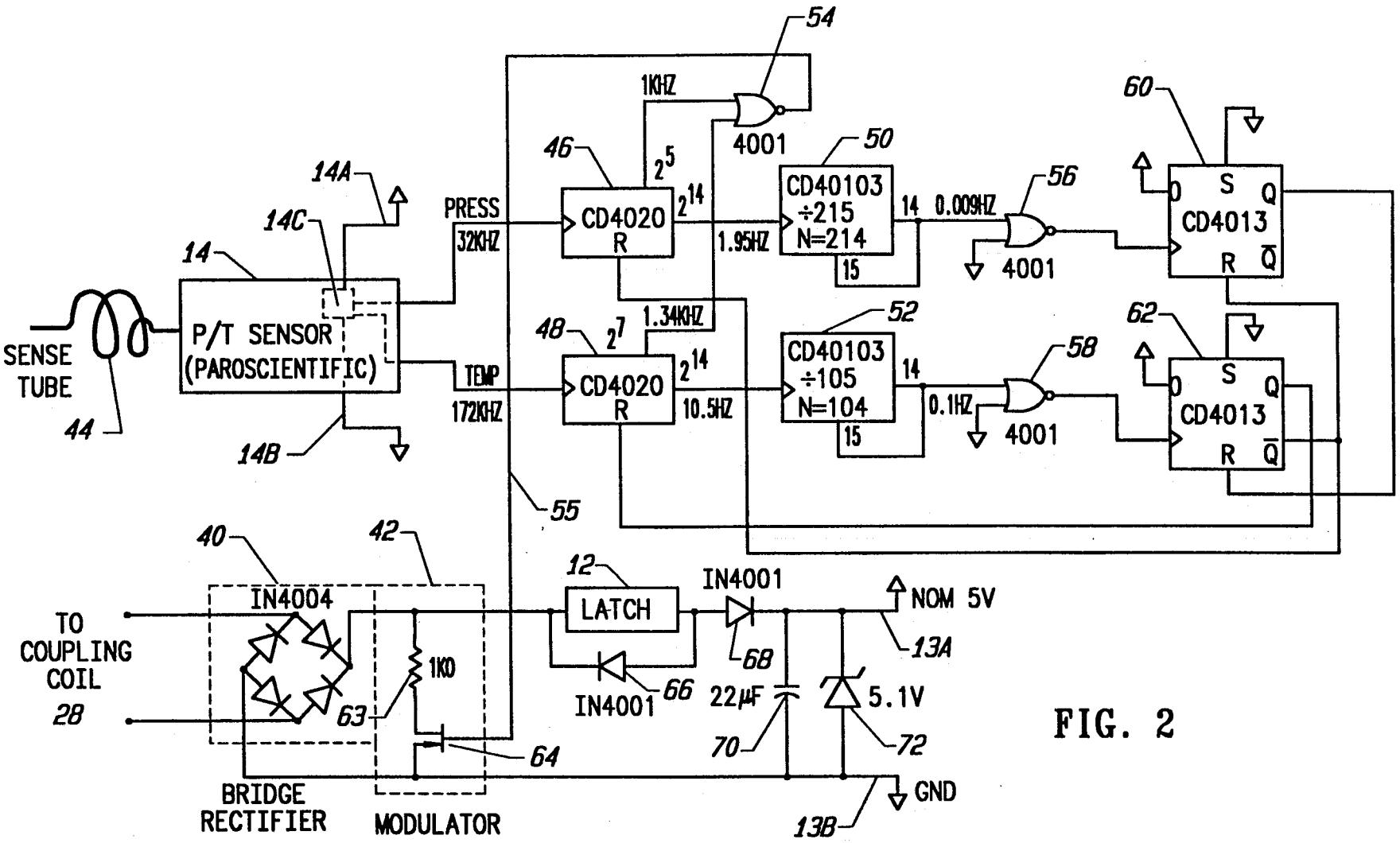
FIG. 2 is a circuit diagram of a preferred embodiment of the downhole electronic components of the invention.

In the preferred embodiment shown in FIG. 2, pressure/temperature sensor 14 (which may be a Series 4000 Digiquartz High Pressure Transducer manufactured by Paroscientific Inc. of Redmond, Washington, or a High Pressure Quartz Crystal Transducer manufactured by Well Test Instruments, Inc., also of Redmond, Washington) produces two continuous square wave outputs: a signal whose frequency (in the approximate range from 172.000Khz at 0 degrees Celsius to 172.800 KHz at 100 degrees Celsius) varies with temperature; and a signal whose frequency (in the 10 approximate range from 32 kHz at zero pressure to 38 kHz at fullscale pressure, e.g., 10,000 psi) varies with pressure. The pressure signal's frequency is divided by 32 in frequency divider circuit 46, and the temperature signal's frequency is divided by 128 in frequency divider circuit 48.

It should be appreciated that sensor 14 may alternatively be a sensor which measures only pressure, a sensor which measures temperature only, or a sensor which measures some other parameter. 20 Alternatively, sensor 14 may generate time-multiplexed data signals at a single output terminal, wherein the frequency of each data signal is indicative of a different measured parameter. Additional downhole equipment, such as a perforating gun, may be attached to tubing 8 and electrically connected to coil 28 (or to another coupler coil vertically spaced from coil 28).

In the FIG. 2 embodiment, only one of dividers 46 and 48 operates at any given time, the other one is held in a reset state by the complementary outputs of flip-flop 62. The outputs of dividers 46 and 48 are combined in NOR gate 54. The output of NOR gate 54 (the signal on line 55) drives modulator 42 directly.

The flip-flop state, and hence the frequency of the output of NOR gate 54, is determined by dividing the pressure signal from sensor 14 by $2^{14}$ in divider 46 and then by 215 in divider 50 (yielding a pulse at the end of about 100 seconds), and by dividing the temperature signal from sensor 14 by $2^{14}$ in divider 48 and then by 105 in divider 52 (yielding a pulse at the end of about 10 seconds). The pulses output from divider 50 (52) are inverted in NOR gate 56 (58), and supplied to flip-flop 60 (62) to set the flip-flop's state to enable the channel (pressure or temperature) opposite the one causing the state change. The FIG. 2 circuit will thus alternate between transmitting about 100 seconds of pressure data, and about 10 seconds of temperature data.

Modulator 42 (which consists of resistor 63 and switching FET 64, connected as shown) impresses the sensor data (i.e., the 1 KHz or 1.34 KHz modulations) on coil 28 by applying and removing an additional load, which draws current through coil 28 and the line impedance of conductor 7, resulting in a data frequency voltage appearing at the terminals of coil 28. Coil 28, in turn, inductively couples the sensor data to coupler coil 26, resulting in appearance of a signal frequency voltage at coil 26.

Figure 5:
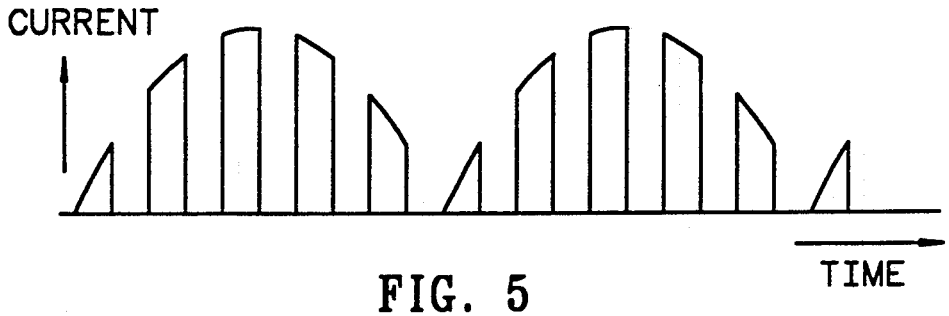
FIG. 5 is a waveform of a signal produced in the FIG. 2 assembly.

FIG. 5 is a typical waveform of the current flowing in 1K ohm resistor 63, when 80 Hz sinusoidal current is inductively coupled from coil 26 to coil 28 and then rectified in full wave rectifier 40. It is apparent from FIG. 5 that modulator 42 draws current slugs whose amplitude envelope is governed by the full wave rectified 80 Hz power signal.

Figure 6:
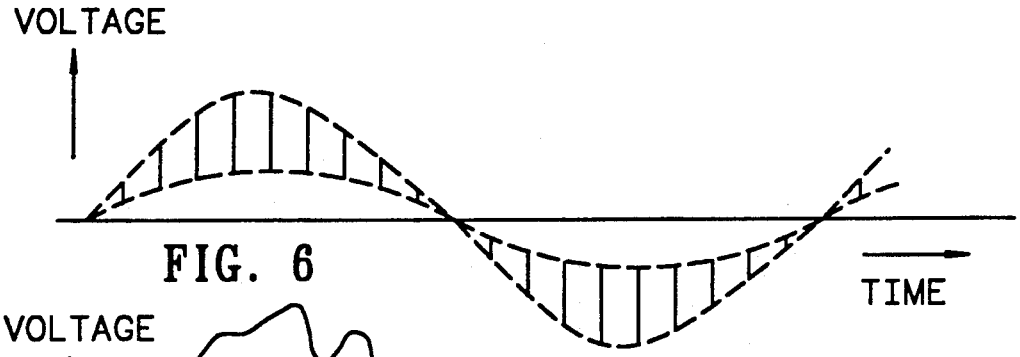
FIG. 6 is a waveform of a signal produced in the FIG. 2 assembly.

FIG. 6 is a typical waveform of the voltage across coupling coil 28 (i.e., the input voltage across rectifier 40). The larger amplitude envelope is governed by the full wave rectified 80 Hz signal when modulator 42 is not conducting, and the smaller amplitude envelope is governed by the full wave rectified 80 Hz signal when modulator 42 is conducting (modulator 42 draws down the voltage due to the increased load).

Figure 7:
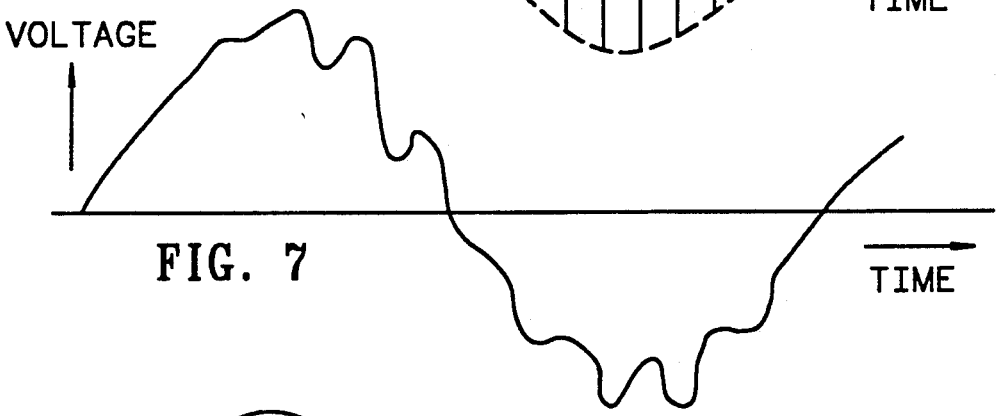
FIG. 7 is a waveform of a signal produced in the FIG. 2 assembly.

FIG. 7 is a typical waveform of the modulated voltage across coupling coil 26 (i.e., the voltage across the lower terminals of conductor 7 in the annulus between casing 4 and tubing 8).

Figure 8:
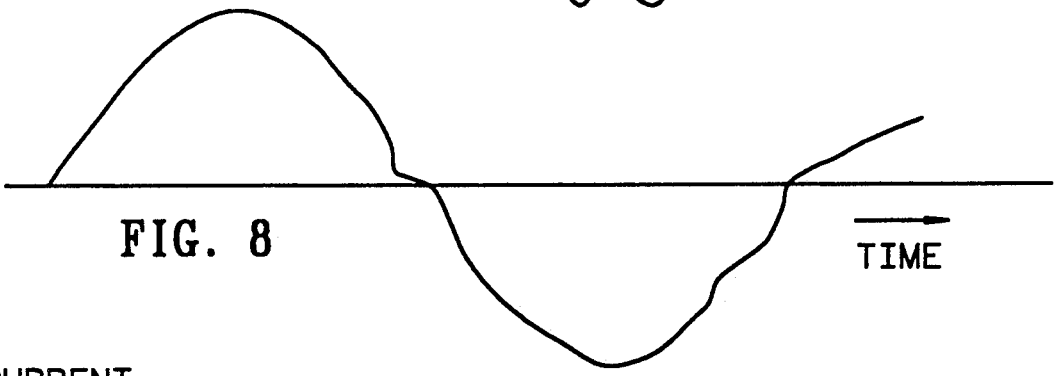
FIG. 8 is a waveform of a signal produced in the FIG. 2 assembly.

FIG. 8 is a typical waveform of the modulated voltage across outer wellhead coupler coil 22 (i.e., the voltage induced across the output terminals of driver/-receiver circuit 30). This signal (referred to herein as the "drive" signal) is filtered and processed by driver/-receiver circuit 30 in a manner to be described with reference to FIG. 4 to extract the sensor data contained in the drive signal. As is evident from comparison of the FIG. 7 and FIG. 8 waveforms, the phase of the modulation impressed on the drive signal shifts with respect to the drive signal with increasing distance uphole, and the amplitude of the modulation decreases drastically (with respect to the AC power signal amplitude) as it travels up to the surface detector.

With reference again to FIG. 2, the rectified power signal across terminals **13*a* and 13*b* is applied across terminals 14*a* and 14*b* of sensor 14 to power the sensor 14 as well as the other electronic circuits downhole (i.e., 46, 48, 50, 52, 54, 56, 58, 60, and 62). Voltage limiting Zener diode 72 across terminals 13*a* and 13*b* is provided to ensure that failure of sensor 14 to open, short, or reach any condition in between, will not cause latch 12 (and hence valve 10**) to become inoperative, and to ensure that the voltage on the sensor and electronics is stable and does not rise to levels likely to cause damage to these components.

Figure 4:
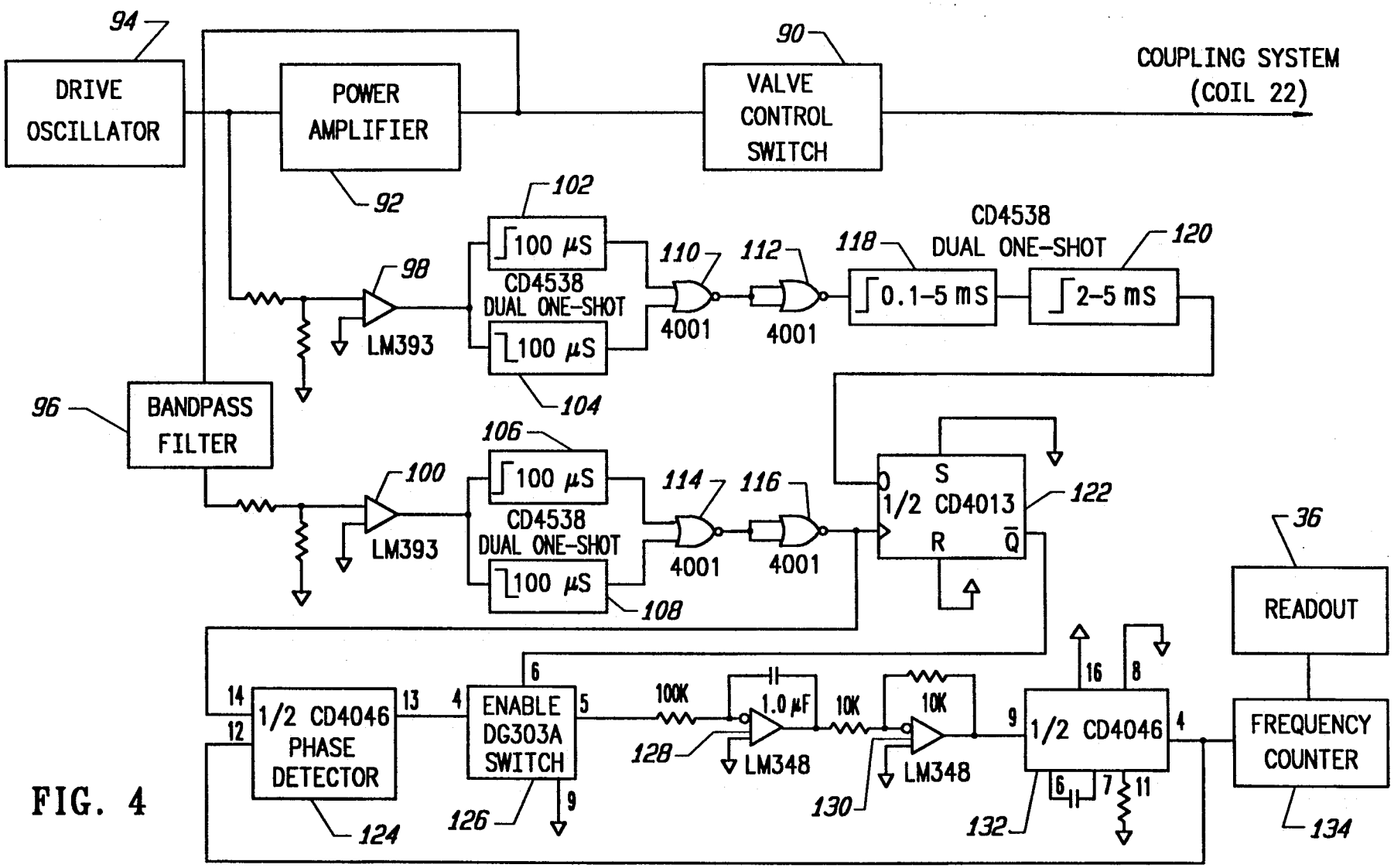
FIG. 4 is a circuit diagram of a preferred embodiment of the surface electronic components of the invention.

Latch 12 (connected as shown to diodes 66 and 68, capacitor 70, and Zener diode 72) actuates or enables safety valve 10 upon application of the AC power to coil 28 (such AC power signal being controlled by valve control switch 90 shown in FIG. 4).

In FIG. 2, circuits 60 and 62 are preferably commercially available CD4013 integrated circuits, divider circuits 50 and 52 are preferably commercially available CD40103 integrated circuits, and circuits 54, 56, and 58 are preferably commercially available CD4001 integrated circuits. Circuits 46 and 48 are preferably commercially available CD4020 integrated circuits.

Figure 3:
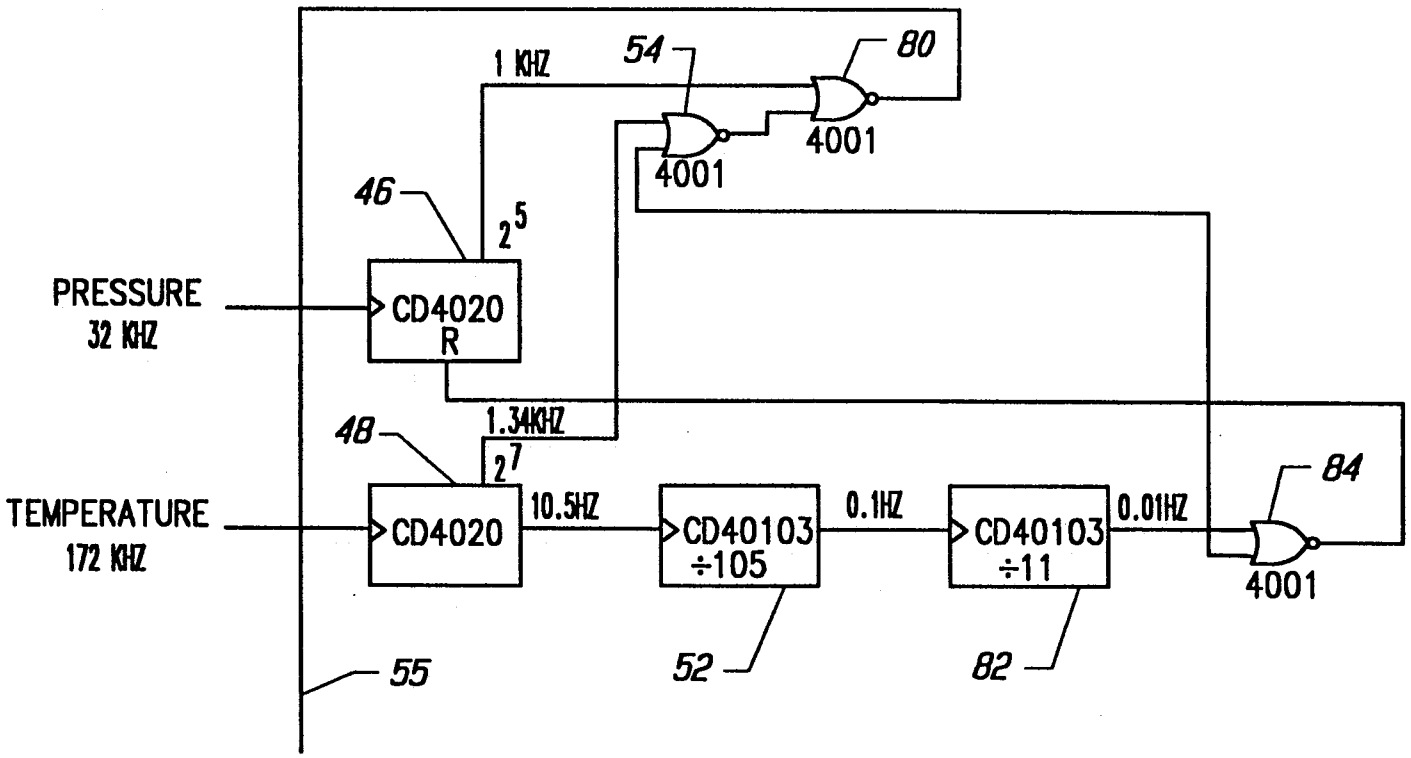
FIG. 3 is a circuit diagram of an alternative circuit to replace a portion of the FIG. 2 assembly.

FIG. 3 is an alternative preferred embodiment of a portion of the FIG. 2 circuitry. In FIG. 3, dividers 46 and 48 are identical to their counterparts in FIG. 2, although both operate simultaneously in FIG. 3 (in contrast with the FIG. 2 embodiment, in which only one of the dividers operates at any given time). Because both dividers 46 and 48 are working at the same time in FIG. 3, the power consumption of the FIG. 3 embodiment is marginally greater than that of the FIG. 2 embodiment. The temperature signal (in the approximate range of 172.000 KHz at zero degrees Celsius to 172.800 KHz at 100 degrees Celsius) is employed in FIG. 3 to control the timebase for time division multiplexing the pressure and temperature data. In the FIG. 3 embodiment, the temperature sensing means within sensor 14 has a nominal frequency of 172.400, and a small dynamic frequency range (plus or minus 0.400 Hz) in comparison with the nominal frequency.

In FIG. 3, alternation of the pressure and temperature signals is obtained by dividing the 172 KHz temperature signal from sensor 14 by $2^{14}$ in divider 48, to obtain a 10.5 Hz signal, then further dividing the 10.5 Hz signal by 105 in divider 52 (to obtain a 0.1 sec. pulse every 10 seconds), and then by 11 in divider 82 (to obtain a 10 second pulse every 110 seconds). The output of divider 82 is supplied to both inputs of NOR gate 84 (which acts as an inverter) and to one input of NOR gate 54.

The output of NOR gate 84 (a 10 second pulse occurring every 110 seconds) is supplied to the reset terminal of divider 46 to hold off the pressure signal. At the same time, the output of divider 82 enables the temperature signal to be conducted through NOR gate 54 and NOR gate 80 to modulator 42 by means of line 55. This results in alternating transmission of 110 seconds of pressure data followed by 10 seconds of temperature data.

The 1.34 KHz output of divider 48 is supplied to one input of NOR gate 54. The output of NOR gate 54 and the output of divider 46 (a 1 KHz signal) are combined in NOR gate 54. The output of NOR gate 80 (the signal on line 55) drives modulator 42 directly, to impress 1 KHz or 1.34 KHz modulations on coil 28.

The FIG. 3 embodiment has less components than does the FIG. 3 embodiment, and thus may be more reliable.

In all embodiments, the modulations impressed on coil 28 by the downhole circuitry of the invention should have frequency within a range that may be communicated through the coupler coils employed in the invention. The power consumed by sensor 14, modulator 42, and the components connected therebetween, typically amounts to less than 20 mWatts.

Figure 10:
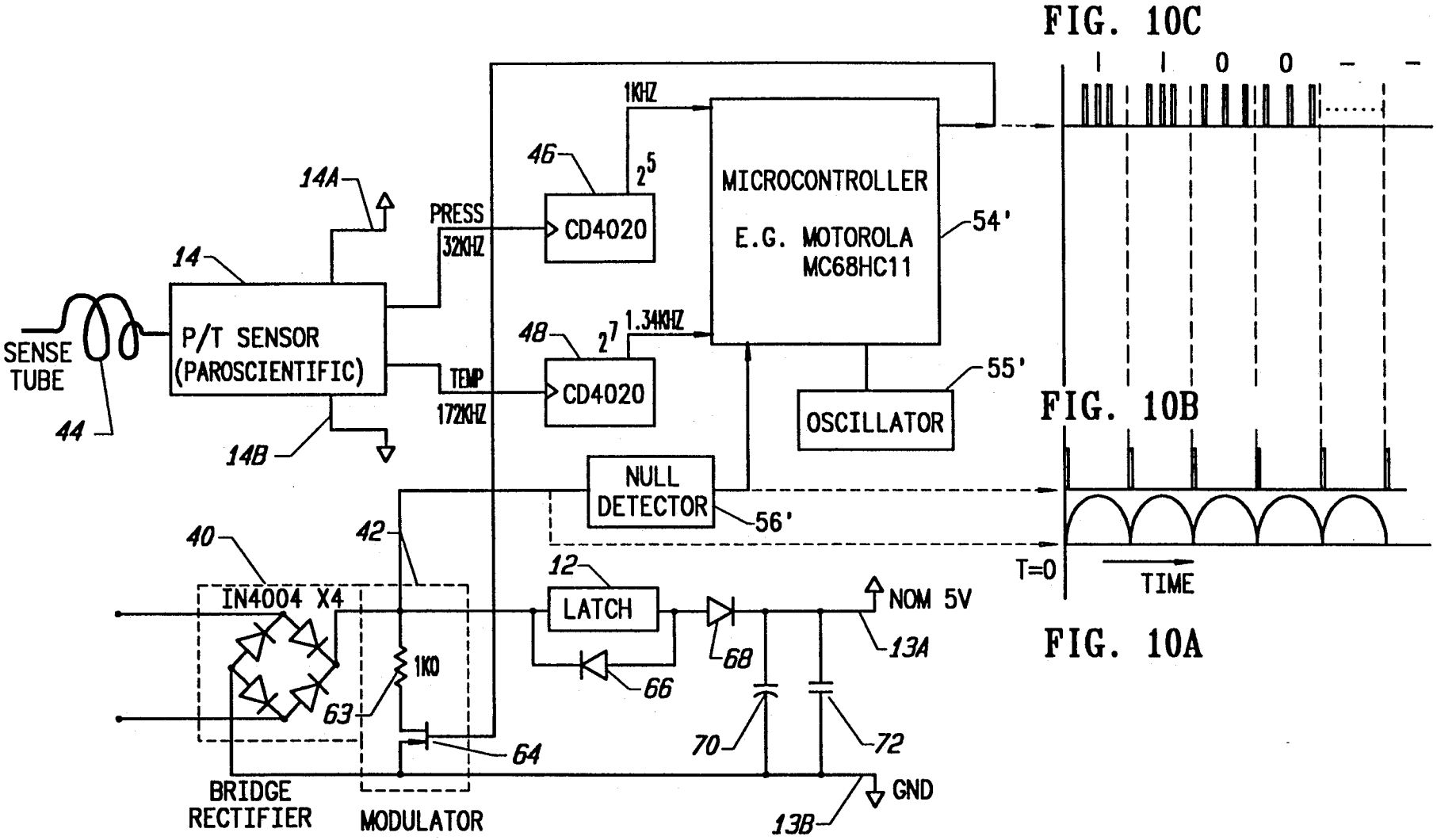
FIG. 10 is another embodiment of the downhole circuitry of the invention.

In another class of embodiments (to be described next with reference to FIG. 10) of the downhole circuitry of the invention, sensor 14 supplies its frequency signals to frequency dividers 46 and 48 (as in the FIG. 2 embodiment), and the 1 KHz and 1.34 KHz signals output by circuits 46 and 48 are then supplied to microcontroller 54' (which may be a Motorola MC68HC11 integrated circuit) in which their frequency is measured (such as by an input capture timer (not shown). Null detector 56' monitors the full wave rectified output of bridge rectifier 40, and supplies to microcontroller 54' a stream of pulses (at a frequency of 160 Hz, in the preferred embodiment in which 80 Hz power is received at rectifier 40 from coil 28). Each pulse in the stream of pulses emerging from circuit 56' (signal "b" in FIG. 10) indicates the time at which the rectified power signal (signal "a" in FIG. 10) crosses through zero.

Microcontroller 54' modulates the sensor data from dividers 46 and 48, and outputs the modulated data in a serial digital format (signal "c" in FIG. 10) of the type employed in conventional FSK data communication systems. The serial digital data signal from microcontroller 54' is employed in modulator 42 to modulate the AC power signal at coil 28, and is divided into cells. Each cell contains pulses at a first frequency (representing a binary "one") or pulses at a second frequency (representing a binary "zero"). The start of each cell coincides with one of th pulses supplied by null detector 56' to circuit 54'. The FIG. 10 embodiment thus allows data concerning the sensed parameters to be transmitted in digital format to the surface at a data rate of 160 baud.

FIG. 4 is a preferred embodiment of driver/receiver circuit 30 (and readout 36) shown in FIG. 1. An alternating (AC) drive signal is generated in drive oscillator 94, amplified in amplifier 92, and supplied to coil 22. Amplifier 92 is configured as a current source (exhibiting a large output source impedance). Valve control switch 90 is connected so as to short circuit the output of amplifier 92 when actuated, to remove the AC power signal from coil 22, causing above-described latch 12 to release and close the downhole safety valve.

Coil 22 also receives modulated data signals from coil 24. The combined voltage appearing at the terminals of coil 22 is denoted as the "drive" signal. The drive signal is sampled at the output of amplifier 92, and is filtered by bandpass filter 96. Filter 96 extracts the data signal frequency (which is preferably in the range from about 1.0 KHz to about 1.5 KHz) from the drive signal, and pulses synchronous with the zero crossings of the filtered output of circuit 96 are generated (by circuits 100, 106, 108, 114, and 116) just as pulses are generated at the zero crossings of the AC power signal from oscillator 94 are generated (by circuits 98, 102, 104, 110, and 112).

Figure 9:
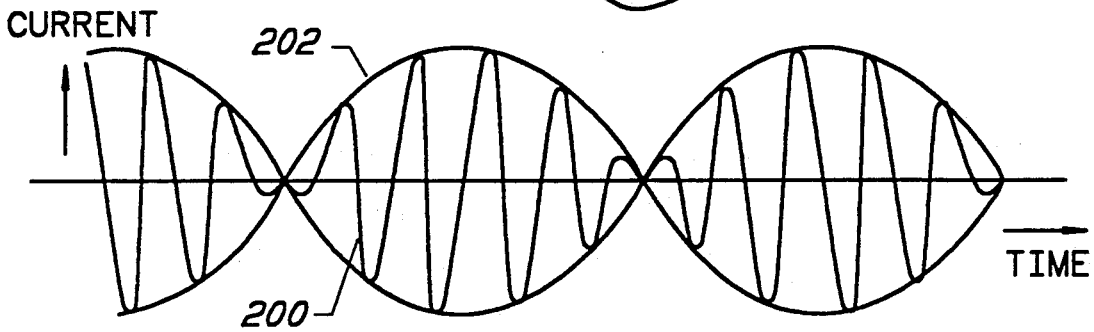
FIG. 9 is a waveform of a signal produced in the FIG. 4 assembly.

FIG. 9 is a typical waveform of the current 200 at the output of filter 96 while data is being received from coil 22. The out-of-band noise has been removed from the signal of FIG. 9, leaving data signal 200, which is modulated by a 160 Hz envelope. It should be appreciated that 160 Hz carrier signal 202 is not actually present (separately from signal 200) at the output of filter 96, and is shown in FIG. 9 merely to illustrate the nature of signal 200's envelope.

Because data signal from coil 22 will have periods of large signal amplitude synchronously with the drive signal (although not necessarily in phase with the drive signals), the drive signal is sampled by LM 393 zero crossing detector 98, which triggers the two halves (102 and 104) of the upper left CD4538 dual one-shot circuit shown in FIG. 4. The output of circuits 102 and 104 are positive (100 microsecond) pulses at both the positive and negative zero crossings of the drive signal. These positive pulses are combined in NOR gate 110, and the output of gate 110 propagates through NOR gate 112 to first half 118 of the upper right CD4538 dual one-shot circuit shown in FIG. 4. Circuit 118 generates a fixed delay from each zero crossing pulse sufficient to align the window signal generated by second half 120 (of the upper right CD4538 dual one-shot circuit) with the maximum amplitude portion of the signal. This window controls the "D" input of flip-flop 122.

The filtered output of filter 96 is sampled by LM 393 zero crossing detector 100, which triggers the two halves (106 and 108) of the lower CD4538 dual one-shot circuit shown in FIG. 4. The output of circuits 106 and 108 are positive (100 microsecond) pulses at both the positive and negative zero crossings of the drive signal. These positive pulses are combined in NOR gate 114, and the output of gate 114 propagates through NOR gate 116 to the clock input of flip-flop 122.

Hence the "Qnot" output terminal of flip-flop 122 is driven low by the first zero crossing pulse inside the window. The low state of the "Qnot" terminal is applied to the enable input of DG303A switch 126, to close the feedback loop of the phase locked loop circuitry of FIG. 4.

The signal zero crossing pulses (from the output of NOR gate 116) are supplied to one of the inputs of phase detection circuit 124 of the phase locked loop, and the output of voltage controlled oscillator (VCO) circuit 132 is fed back to the other input of phase detector 124. Switch 126 receives the output of phase detector 124.

Because the sensor data is modulated onto a rectified sinusoidal waveform downhole, the data as received at the surface is amplitude modulated at twice the primary drive frequency (i.e., at 160 Hz, which is twice the 80 Hz primary drive frequency in the preferred embodiment). As a result, the data amplitude periodically goes to zero regardless of how good the signal to interference ratio may be. To avoid errors in the determination of the sensor data frequency, the sensor data signal is sampled only during those portions of the 80 Hz cycle when the sensor data signal amplitude is largest. Since this is a deterministic function, the 80 Hz drive reference signal is used to determine the periods when the sensor data signal is largest.

Since the phase error signal that is output from circuit 124 is meaningful only when the filtered signal (output from filter 96) has sufficiently large amplitude, switch 126 will close the phase locked loop to permit such phase error signal to correct the frequency and phase of voltage controlled oscillator (VCO) circuit 132 only when gating signal "Qnot" is in its low state (which occurs when the filtered signal output from filter 96 has a value above a predetermined threshold).

When switch 126 is enabled, the output of switch 126 is supplied to integrator circuit 128. Integrator 128 (preferably a commercially available LM348 circuit) outputs the input voltage required to operate VCO 132 at the correct frequency, and as employed in the closed loop, integrator 128 realizes a single pole transient response characteristic. Second LM348 circuit 130, connected to the output of circuit 128, simply provides a gain of negative one, to ensure that the VCO control signal is supplied to VCO 132 with correct polarity.

VCO 132 is a continuously operating square wave oscillator whose output signal is supplied to frequency counter 134 (and also as a feedback signal to the second input of phase detector 124), so that its frequency can be measured in circuit 134 by any well known frequency counting technique. The output frequency of VCO 132 is displayed by readout unit 36. Preferably, unit 36 converts the sensor frequency from unit 134 into a representation of the physical quantity (i.e., pressure or temperature) represented by the sensor frequency, and displays this representation.

In the FIG. 4 embodiment, the phase locked loop is stable enough to "freewheel" through periods between bursts of pulses from switch 126, in the sense that the output frequency from VCO 132 remains substantially constant during those portions of the 80 Hz cycle when gating signal "Qnot" (from circuit 122) is "off" so that switch 126 (and hence the phase locked loop) is open.

In a variation on the FIG. 4 embodiment, gating signal "Qnot", along with the signal zero crossing pulses output from NOR gate 116, are supplied as inputs to a timer in a microprocessor that can measure the data frequency and derive smoothed estimates of the sensor data by averaging the frequency measurements over a large number of pulse bursts.

Although FIG. 4 includes a hardware phase locked loop (which demodulates the phase-modulated data signal from the downhole sensor to extract frequency data representing the sensor output), it is contemplated that a software-implemented phase locked loop (which performs substantially the same functions as have been described with reference to FIG. 4) may be substituted for such hardware phase locked loop.

A single commercially available CD4046 integrated circuit may be used to implement both phase detection circuit 124 and VCO circuit 132, as suggested in FIG. 4.

In one version of the FIG. 4 embodiment, frequency counter 134 measures the period of VCO 132's output, and inverts this period to obtain the frequency.

Various modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. An apparatus for transmitting signals between surface equipment and downhole equipment, including:

a set of inductive coupling coils, including a first downhole coil and a second downhole coil separated by a pressure barrier from the first downhole coil, for inductively coupling an AC drive signal from the surface equipment to the downhole equipment; wherein the downhole equipment includes:

a sensor, for generating a data signal having a frequency indicative of a measured quantity;

a rectifier for receiving the AC drive signal from the first downhole coil and generating a rectified signal from the received AC signal; and a modulator connected between the first downhole coil and the sensor, for receiving the data signal and impressing on the first downhole coil a modulation indicative of the data signal frequency.

2. The apparatus of claim 1, wherein the set of inductive coupling coils includes a first surface coil electrically connected to the second downhole coil and a second surface coil inductively coupled to the first surface coil, and wherein the surface equipment also includes:

detection means connected to the second surface coil for detecting the data signal frequency.

3. An apparatus for transmitting signals between surface equipment and downhole equipment, including:

a set of inductive coupling coils, including a first downhole coil and a second downhole coil separated by a pressure barrier from the first downhole coil, for inductively coupling an AC drive signal from the surface equipment to the downhole equipment; wherein the downhole equipment includes:

a sensor, for generating a data signal having a frequency indictive of a measured quantity, wherein the sensor generates a first data signal having a first frequency indictive of a first measured quantity and a second data signal having a second frequency indicative of a second measured quantity;

a rectifier for receiving the AC drive signal from the first downhole coil and generating a rectified signal from the received AC signal; and a modulator connected between the first downhole coil and the sensor, for receiving the data signal and impressing on the first downhole coil a modulation indicative of the data signal frequency, wherein the modulator includes means for alternately impressing on the first downhole coil a first modulation indicative of the first frequency and a second modulation indicative of the second frequency.

4. The apparatus of claim 3, wherein the first data signal has a nominal frequency, and a dynamic frequency range that is small in comparison with the nominal frequency, and wherein the modulator employs the first data signal to control the timebase for time division multiplexing the first data signal and the second data signal.

5. An apparatus for transmitting signals between surface equipment and downhole equipment, including:

a set of inductive coupling coils, including a first downhole coil and a second downhole coil separated by a pressure barrier from the first downhole coil, for inductively coupling an AC drive signal from the surface equipment to the downhole equipment; wherein the downhole equipment includes:

a sensor, for generating a data signal having a frequency indicative of a measured quantity, wherein the sensor generates a first data signal having a first frequency indicative of a first measured quantity and a second data signal having a second frequency indicative of a second measured quantity, and wherein the first data signal and the second data signal are time division multiplexed;

a rectifier for receiving the AC drive signal from the first downhole coil and generating a rectified signal from the received AC signal; and a modulator connected between the first downhole coil and the sensor, for receiving the data signal and impressing on the first downhole coil a modulation indicative of the data signal frequency.

6. An apparatus for transmitting signals between surface equipment and downhole equipment, including:

a set of inductive coupling coils, including a first downhole coil and a second downhole coil separated by a pressure barrier from the first downhole coil, for inductively coupling an AC drive signal from the surface equipment to the downhole equipment; wherein the downhole equipment includes:

a sensor, for generating a data signal having a frequency indicative of a measured quantity, wherein the sensor generates a first data signal having a first frequency indicative of temperature and a second data signal having a second frequency indicative of pressure;

a rectifier for receiving the AC drive signal from the first downhole coil and generating a rectified signal from the received AC signal; and a modulator connected between the first downhole coil and the sensor, for receiving the data signal and impressing on the first downhole coil a modulation indicative of the data signal frequency.

7. The apparatus of claim 1, wherein the downhole equipment also includes a safety valve, and a solenoid latch for controlling the safety valve, and wherein the latch controls the valve in response to the presence or absence of the AC drive signal.

8. The apparatus of claim 1, wherein the rectified signal is supplied to the sensor to power said sensor.

9. An apparatus for transmitting signals between surface equipment and downhole equipment, including:

a set of inductive coupling coils, including a first downhole coil and a second downhole coil separated by a pressure barrier from the first downhole coil, for inductively coupling an AC drive signal from the surface equipment to the downhole equipment; wherein the downhole equipment includes:

a sensor, for generating a data signal having a frequency indicative of a measured quantity, wherein the sensor includes power terminals;

voltage limiting diode means connected across said power terminals;

a rectifier for receiving the AC drive signal from the first downhole coil and generating a rectified signal from the received AC signal, wherein the rectified signal is supplied to the sensor to power said sensor; and a modulator connected between the first downhole coil and the sensor, for receiving the data signal and impressing on the first downhole coil a modulation indicative of the data signal frequency.

10. A surface apparatus for communicating with downhole equipment, including:

drive means for generating an AC signal;

a pair of inductive coupling coils coupled to the drive means, for receiving the AC signal and a modulated data signal having modulations indicative of a downhole sensor frequency;

a phase locked loop connected to a first of the coils, for receiving the current signal at said first coil and generating therefrom a demodulated signal indicative of the downhole sensor frequency, and including a means for closing the phase locked loop only when the current signal has a value above a predetermined threshold.

11. The apparatus of claim 10, wherein the AC signal has a primary frequency in the range from 70 Hz to 100 Hz.

12. The apparatus of claim 10, also including means for displaying the downhole sensor frequency or a value derived from the downhole sensor frequency.

13. The apparatus of claim 10, also including a band pass filter connected between the phase locked loop and the first coil, for passing frequency components in the range from about 1.0 KHz to about 1.5 KHz, wherein said modulations indicative of a downhole sensor frequency have frequency components in the range from about 1.0 KHz to about 1.5 KHz.

14. The apparatus of claim 10, also including means for measuring the period of an output signal from the phase locked loop, and for inverting the measured period to obtain the downhole sensor frequency

15. An apparatus for communicating with surface equipment, including:

a first coil and a second coil separated by a pressure barrier from the first coil, wherein the second coil will inductively couple to the first coil an AC drive signal received from the surface equipment, and wherein the AC drive signal has a primary frequency component;

a sensor for generating a data signal having a frequency indicative of a measured quantity;

a rectifier for receiving the AC drive signal from the first coil and generating a rectified signal from the received AC signal; and a modulator connected between the first coil and the sensor, for receiving the data signal and impressing on the first coil a modulation indicative of the data signal frequency.

16. The apparatus of claim 15, wherein the data signal is a frequency shift keyed digital signal.

17. The apparatus of claim 16, wherein the sensor receives the rectified signal, and wherein the sensor includes a means for generating from the rectified signal a set of time windows which are synchronous to said primary frequency component, but which are phase shifted by a predetermined amount, for use in generating said frequency shift keyed digital signal.

18. The apparatus of claim 15, also including:

a first surface coil electrically connected to the second coil, and a second surface coil inductively coupled to the first surface coil; and detection means connected to the second surface coil for detecting the data signal frequency.

19. The apparatus of claim 15, wherein the sensor generates a first data signal having a first frequency indicative of a first measured quantity and a second data signal having a second frequency indicative of a second measured quantity, and wherein the modulator includes means for alternately impressing on the first coil a first modulation indicative of the first frequency and a second modulation indicative of the second frequency.

20. The apparatus of claim 19, wherein the first data signal has a nominal frequency, and a dynamic frequency range that is small in comparison with the nominal frequency, and wherein the modulator employs the first data signal to control the timebase for time division multiplexing the first data signal and the second data signal.

21. The apparatus of claim 15, wherein the sensor generates a first data signal indicative of a first measured quantity and a second data signal indicative of a second measured quantity, wherein the first data signal and the second data signal are time division multiplexed.

22. The apparatus of claim 15, wherein the sensor generates a first data signal having a first frequency indicative of temperature and a second data signal having a second frequency indicative of pressure.

23. The apparatus of claim 15, also including:

a safety valve; and a solenoid latch for controlling the safety valve, wherein the latch controls the valve in response to the presence or absence of the AC drive signal.

24. A surface apparatus for detecting a data signal from a downhole sensor, wherein the data signal has a data signal frequency within a sensor frequency range, and wherein the data signal frequency is indicative of a measured quantity, including:

an AC power driver for generating an AC signal having a primary frequency component with a primary frequency outside the sensor frequency range;

a first coil connected to the driver, for receiving the AC signal, wherein the first coil has a current;

a second coil separated from the first coil by a pressure barrier, for receiving the data signal and inductively coupling the data signal to the first coil;

a band pass filter connected to the first coil, for passing frequency components of the first coil current within the sensor frequency range, but not passing frequency components of the first coil current having the primary frequency;

detection means connected to the first coil and the band pass filter, for receiving the first coil current and the filtered signal passed by the band pass filter, measuring a first signal indicative of the frequency of the filtered signal during each half cycle of the primary frequency component, and determining the data signal frequency from the first signal.

25. The apparatus of claim 24, wherein the detection means determines the data signal frequency only when the first coil current has an amplitude above a predetermined threshold.

26. The apparatus of claim 24, wherein the data signal is a frequency shift keyed digital signal.

27. The apparatus of claim 24, wherein the detection means includes means for displaying a representation of the first signal.

28. The apparatus of claim 24, wherein the sensor frequency range is from about 1.0 KHz to about 1.5 KHz.

29. The apparatus of claim 24, wherein the primary frequency is in the range from 30 Hz to 500 Hz.

30. The apparatus of claim 24, wherein the primary frequency is in the range from 70 Hz to 100 Hz.

31. The apparatus of claim 24, wherein the filtered signal has a period, and wherein the first signal is indicative of the period of the filtered signal.

32. A surface apparatus for communicating with downhole equipment, including:

drive means for generating an AC signal;

a pair of inductive coils coupled to the drive means, for receiving the AC signal and a modulated data signal having modulations indicative of a downhole sensor frequency;

a demodulator connected to a first of the coils, for receiving the current signal at said first coil and generating therefrom a demodulated signal indicative of the downhole sensor frequency, and including a means for enabling the demodulator only when the current signal has a value above a predetermined threshold.

33. The apparatus of claim 32, wherein the AC signal has a primary frequency in the range from 70 Hz to 100 Hz.

* * * * *